US007591362B2

(12) United States Patent
Winau

(10) Patent No.: US 7,591,362 B2
(45) Date of Patent: Sep. 22, 2009

(54) METHOD AND DEVICE FOR SORTING, COUNTING, AND/OR EXAMINING OBJECTS

(75) Inventor: Dominik Winau, Heilbronn (DE)

(73) Assignee: CountR GmbH, Kleinmachnow (DE)

( * ) Notice: Subject to any disclaimer, the term of this patent is extended or adjusted under 35 U.S.C. 154(b) by 0 days.

(21) Appl. No.: 11/159,508

(22) Filed: Jun. 22, 2005

(65) Prior Publication Data

US 2005/0230219 A1 Oct. 20, 2005

Related U.S. Application Data

(63) Continuation of application No. PCT/EP03/14660, filed on Dec. 19, 2003.

(30) Foreign Application Priority Data

Dec. 22, 2002 (DE) ..... 102 61 819

(51) Int. Cl.
*G07D 3/14* (2006.01)
*G07F 1/00* (2006.01)

(52) U.S. Cl. ..... 194/346; 194/344

(58) Field of Classification Search ..... 194/342, 194/343, 344; 198/721; 453/49
See application file for complete search history.

(56) References Cited

U.S. PATENT DOCUMENTS 3,603,327 A * 9/1971 Buchholz et al. ..... 453/57
3,603,646 A * 9/1971 Leoff ..... 406/89
3,698,537 A 10/1972 Black et al.
3,730,595 A 5/1973 Yakubowski
3,747,753 A * 7/1973 Flint ..... 209/555
4,457,434 A 7/1984 Brown et al.
4,531,625 A * 7/1985 Yonekura et al. ..... 194/334
4,607,648 A * 8/1986 Hough ..... 453/9
4,710,068 A 12/1987 Lindstrom et al.
5,207,611 A * 5/1993 Ueda et al. ..... 453/11
5,551,911 A * 9/1996 Rumbach ..... 453/3
6,648,747 B1 11/2003 Zimmermann
6,676,365 B2 * 1/2004 Adam et al. ..... 406/83

FOREIGN PATENT DOCUMENTS

DE 11 99 528 3/1969
DE 25 23 378 12/1976
DE 198 41 860 A1 3/2000
DE 198 17 613 C2 6/2000
DE 199 07 706 A1 8/2000
DE 199 57 483 A1 6/2001
GB 2 298 305 A 8/1996
WO WO 93/16446 8/1993

* cited by examiner

*Primary Examiner*—Patrick Mackey
*Assistant Examiner*—Mark Beauchaine
(74) *Attorney, Agent, or Firm*—Thorpe North & Western LLP

(57) ABSTRACT

A device for sorting, counting and/or examining objects of a collective of objects, in particular, flat objects such as coins or the like, the collective of objects containing objects of different features, comprising an object individualizing device for individualizing the objects of the collective of objects, an object track along which the individualized objects move, after they have left the object individualizing device, an object accelerating means for accelerating the objects when leaving the object individualization device, an object recognition means for recognizing objects having different features, and a means for selectively conveying the objects depending on one or more features of the objects, wherein the object track provides an air cushion on which the objects float.

20 Claims, 2 Drawing Sheets

METHOD AND DEVICE FOR SORTING, COUNTING, AND/OR EXAMINING OBJECTS

RELATED APPLICATIONS

This application is a continuation of international application PCT/EP03/14660 filed Dec. 19, 2003, and which specified the United States, and which is based on DE10261819.4 filed Dec. 22, 2002.

TECHNICAL FIELD

The invention relates to a method and a device for sorting, counting and/or examining objects of a collective of objects, in particular flat objects such as coins or the like, as defined in the preambles of claim 1 or claim 9, respectively.

The invention is described here mainly with reference to coins of a collective of coins. It should be noted, however, that the method of the invention and the device of the invention can be applied not only for the sorting, counting and/or examining of coins of a collective of coins but also for any other appropriate collective of objects, for example for any type of discs in the shape of coins, such as value-representing chips, tokens, stamping blanks, circular coin blanks and the like.

UNDERLYING PRIOR ART

DE 198 41 860 A1 discloses a device for sorting and or counting of different coins of a collective of coins. The coins are individualized by means of a coin individualization device, by stringing them one behind the other for the purpose of sorting and counting. A coin track in the form of a sorting channel is connected to the coin individualization device. The coin individualization device has a filling chute for the coins, a rotating turntable and a coin exit. To individualize the coins, the turntable is put into quick rotation, and the coins are poured onto the turntable. Under the action of centrifugal force, the coins leave the turntable individually and get into the sorting channel. Alternatively, the turntable may have controllable, resilient driving elements for individualizing the coins. The driving elements remove individual coins from the insert chute and move these coins in the direction of rotation up to the sorting channel. The lower strand of a conveyor belt driven by a motor is arranged behind the coin exit of the coin individualization device and above the sorting channel and of the coins lying thereon. The coins are frictionally taken along by this lower strand and are moved through the sorting channel. A plurality of coin traps in the form of sorting openings are provided in the sorting channel, the sizes of these openings being substantially equal to those of the coins to be sorted. Then, coins taken along in this way drop through the respective associated sorting openings, which are of the same size or slightly larger than the respective associated coin. A compartment or container is allotted to each coin trap for accommodating the sorted coins. If the coins are not only to be sorted but are also to be counted, a sensor is associated with each coin trap, by which the coins of the respective trapped coins are counted.

DE 199 57 483 A1 also discloses a device for sorting and/or counting different coins of a collective of coins, which is similar to the device described in DE 198 41 860 A1. Here, also coins are, at first, individualized by means of a turntable, and are then conveyed by means of a conveyor belt along a sorting plate, which has a stepped sequence of sorting openings which match the various coin diameters. Here, the sorting plate is an interchangeable sorting plate, in order to permit easy conversion of the device to another collective of coins.

WO 93/16446 A1 discloses a device for sorting different coins of a collective of coins. This device comprises a coin individualization device in the form if a coin table for individualizing the coins of the collective of coins, and an object track or sorting line, along which the individualized coins move, after they have left the coin individualisation device. Object accelerating means in the form of a draw-off belt or draw-off wheel accelerate the coins when leaving the coin individualization device. A coin recognition device recognizes coins having different features. Means for selectively conveying dependent on one or more features are provided along the sorting line. These means consist of deflecting elements reaching into the sorting line. The sorting line consists of an endless conveyor belt or a plurality of endless conveyor straps, by which the coins are transported along the sorting line.

It has been found that prior art methods and devices for sorting, counting and/or examining objects of a collective of objects suffer from disadvantages. For example, the rate of sorting and counting of coins is very much limited in such devices which operate with a transport belt arranged above an object track provided with sorting openings. It is not possible to increase the speed of the transport belt beyond certain limits, without impairing the accuracy of the sorting or counting or without increasing wear, as, with high speed, it is only then ensured that the objects drop into the correct sorting opening, when the pressure of the transport belt on the coins is increased. Furthermore, visibility and accessibility of the objects on the object track is impaired by the transport belt. The transport belt is subject to heavy wear. Furthermore, the transport belt causes a high level of noise.

DISCLOSURE OF THE INVENTION

It is an object of the invention to improve a method or a device of the type mentioned in the beginning.

In particular, it is an object of the invention to increase the throughput of objects with a method or device mentioned in the beginning.

Furthermore, it is an object of the invention to reduce wear of a device mentioned in the beginning, while achieving high throughput. Furthermore, it is an object of the invention to increase the flexibility and/or the accuracy of the examination of the objects with a method or device mentioned in the beginning.

According to the invention, this object is achieved, with regard to the device, by the characterizing features of claim 1 and, with regard to the method, by the characterizing features of claim 9.

With the method and device of the present invention, the objects to be sorted, counted and/or examined are, at first, individualized and then, during or after leaving the object individualisation device, are accelerated, before they move along the portion of the object track at which they are sorted, counted and/or examined.

In order to reduce the friction between the objects and the object track, the object track has gas- or air cushion-forming means, whereby an air cushion between the objects and the object track is formed. This can be realized by providing the object track with air through-flow openings, through which an air stream is generated. Preferably, these air through-flow openings are shaped such that the objects cannot drop through these openings. The openings may have any shape and may consist, for example, of circular holes or elongated slots.

The air through-flow openings may be inclined in the direction of motion of the objects. Thereby, the air cushion-forming means act as additional accelerating means for the objects on the object track. Because of the acceleration of the objects and the generation of an air cushion between the objects and the object track, no further force-exerting transport means such as a transport belt as provided in the device described in DE 199 57 483 A1 or DE 198 41 860 A1 are required. Thereby, a substantially higher speed on the object track can be imparted to the objects, whereby the throughput of objects can be increased. Thereby the rate of sorting, counting and/or examining of the objects is increased. Furthermore, as no additional force-exerting transport means along the object track are required, the wear of the device can be kept low, in particular with high throughput of objects.

As no mechanically acting transport means such as transport belts or the like need be provided above the object track, the visibility and accessibility of the objects on the object track is substantially improved. Object recognition means or other examining means for testing objects, while these objects are moved on the object track, can be employed more flexibly. As will be described in greater detail below, the objects can then be observed from several sides, whereby the accuracy of the examination of the objects can be improved. This may, for example, be of particular advantage, if, for example, the objects are to be observed by sensors from above and/or from below, while they travel along the object track.

The object accelerating means may be provided both in front of or at the object track. Essential is only that the objects are accelerated, before they are sorted, counted and/or examined. In this case, the duration of acceleration of the individual objects may be selected such that this duration of acceleration is smaller than the run-time of the objects on the object track. The object track may be designed such that the objects move, along a substantial portion of the object track free from mechanically engaging, force-exerting contact means acting in the direction of motion of the coins.

The object accelerating means may be designed in various ways. For example, they may contain flow generating means for generating a flow of a medium, the objects being accelerated by this flow. This can be realized by a compressed air device. The object accelerating means may, however, also comprise mechanically engaging contact means, which engage the objects to be accelerated. Such mechanically engaging object accelerating means may comprise an accelerating wheel the peripheral surface of which engage the objects to accelerate the objects. When the accelerating wheel rotates, the objects are taken along by its peripheral surface and, thereby, accelerated tangentially to the accelerating wheel.

In particular when sorting, counting and examining coins, it is advantageous to ensure that the objects (coins) cannot get unintentionally into the object track. To this end, means for preventing unintentional transport of objects from the object individualization device to the object track can be provided between the object individualization device and the object track. These means may comprise stop means by which the objects are detained, the objects being moved past the stop means only by the action of the object accelerating means. The stop means may be an inclination or an offset of the object track relative to the object individualization device.

For sorting, counting and/or examining the objects, the objects may be observed on the object track and may be classified after certain features. To this end, the object track may have a transparent section, for example in the form of a sapphire glass, through which the objects on the object track can be observed.

An embodiment of the invention is described hereinbelow with reference to the accompanying drawings.

PREFERRED EMBODIMENT OF THE INVENTION

Figure 1:
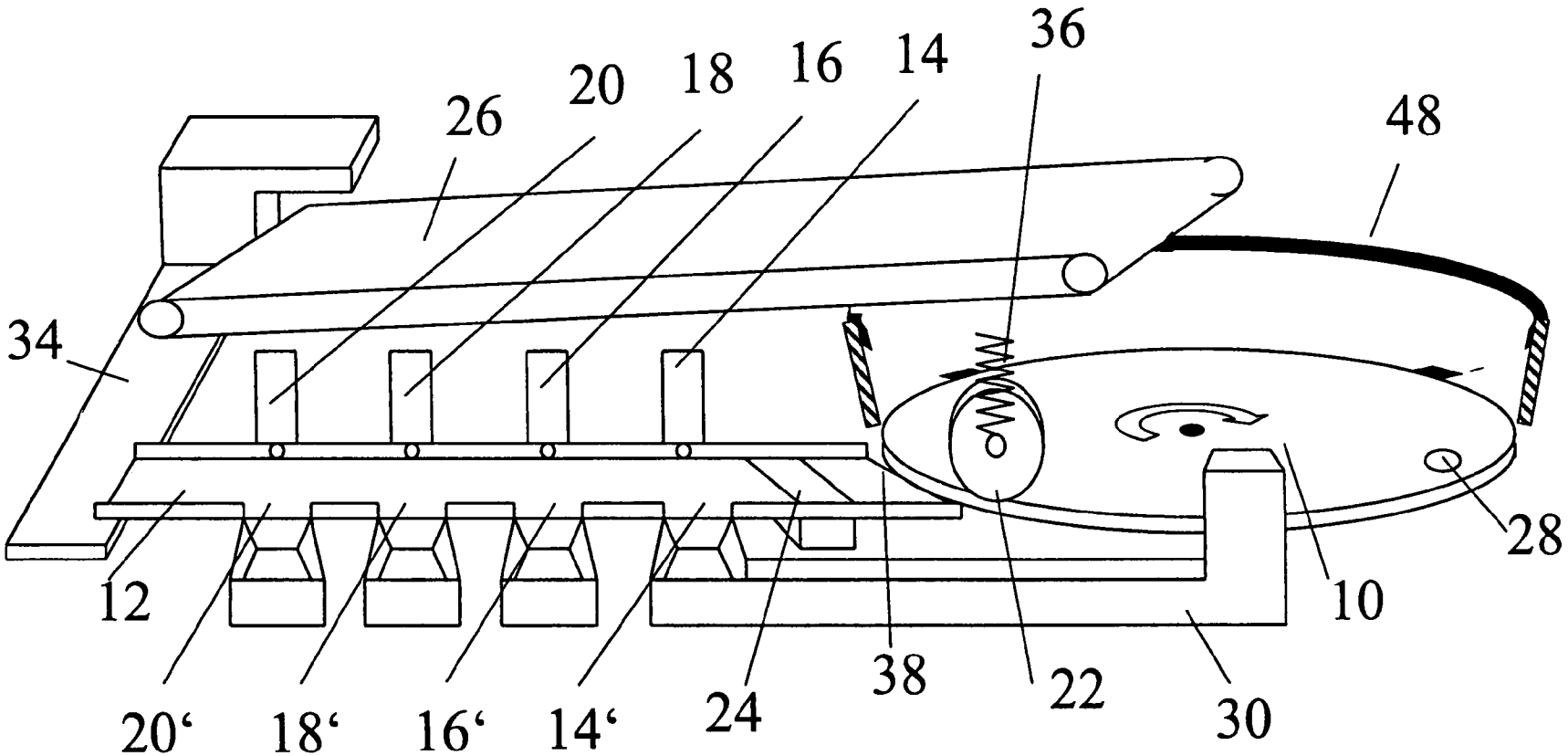
FIG. 1 is a schematic illustration and shows a device for sorting, counting and/or examining coins.
Figure 2:
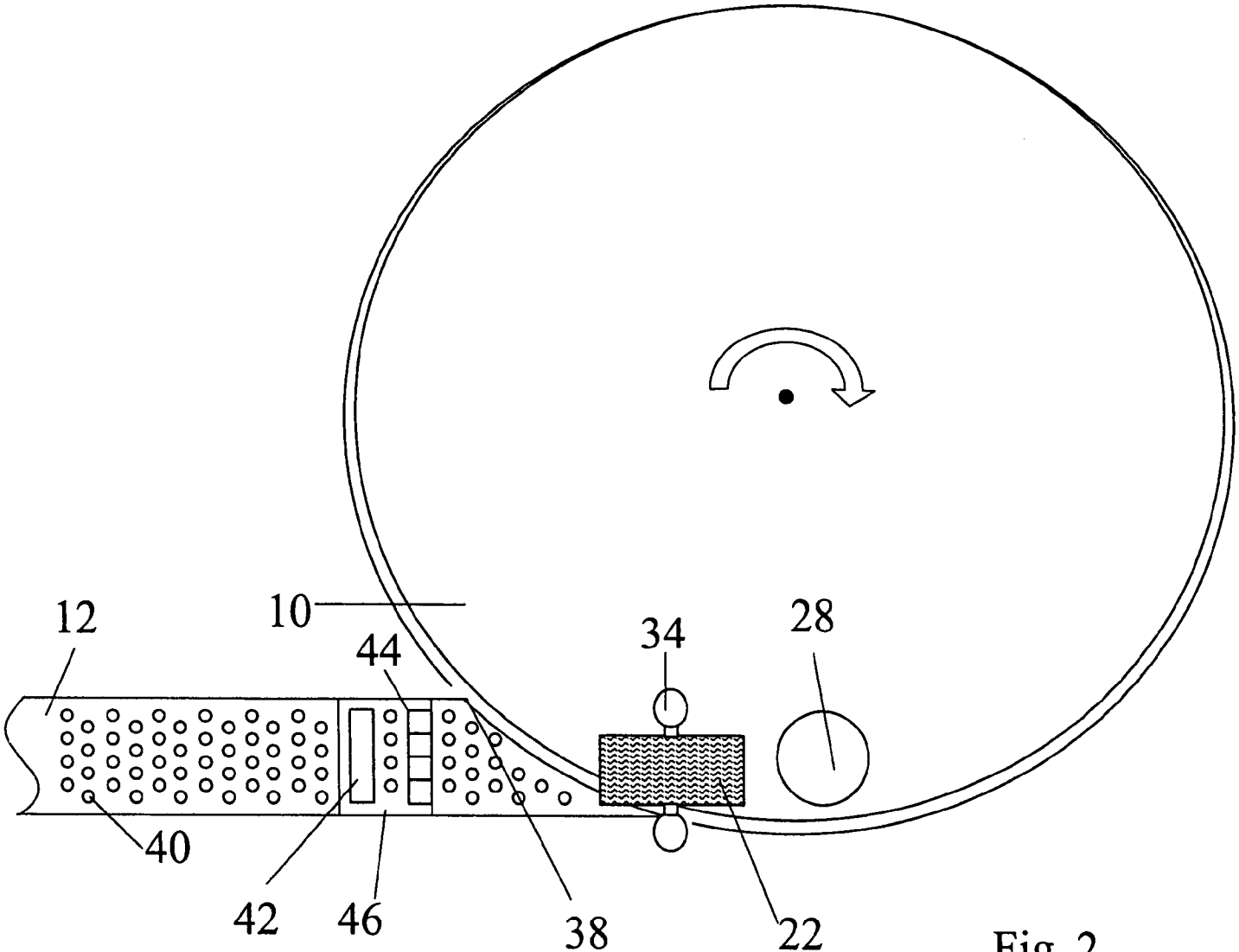
FIG. 2 is a schematic illustration and shows part of the device of FIG. 1.

Referring to FIGS. 1 and 2, numeral 10 designates a turntable of metal. The turntable 10 is driven by an electric motor with transmission and is caused to rotate. The turntable is surrounded by a metal housing 48, which forms a cylindrical wall along the edge of the turntable 10. A coin track 12 is attached to the turntable 10. The coin track 12 is also made of metal. In the illustrated embodiment, the coin track 12 is straight. It may, however, also be curved horizontally or vertically. Deflection devices 14, 16, 18 and 20 are provided along the coin track 12. These deflection devices are designed as magnetically actuated valves for compressed air. Opposite the deflection devices 14, 16, 18 and 20, associated deflection openings 14', 16', 18' and 20', respectively, are provided, which are shaped as slots and which are funnel-like enlarged in the extension thereof to permit hanging money bags thereon. (Of course, the device may also be provided with a larger or small number of such (or other) deflection devices and deflection openings). Coin accelerating means in the form of a accelerating wheel 22 are provided near the transition between the turntable 10 and the coin track 12. The accelerating wheel is driven by a motor and transmission and runs at a higher speed than the turntable. The accelerating wheel is resiliently mounted and has a gummed surface. The wall of the housing 48 has an opening here. A coin recognizing device 24 for recognizing coins of different features is provided between the accelerating wheel and the first deflecting device. This coin recognizing device is mounted below a disc of sapphire glass, which is embedded in the coin track, and comprises a CCD-array with illumination. In addition, magnetic and inductive sensors are embedded in the coin track 12.

The illustrated device for sorting, counting and/or examining of coins operates as follows.

Coins of a collective of coins are poured on the rotating turntable 10. This can be done either directly or, for example, by placing the coins on a conveyor belt 26 which feeds the coins to the turntable 10. The conveyor belt 28 is controlled in such a way that the coins are fed to the turntable at the same rate at which they are processed. In the Figures, such a coin placed on the turntable is designated by numeral 28. Due to the rotation of the turntable 10, the coins are urged by the centrifugal force to the edge of the turntable 10, while lying flat on the turntable, and are guided by the wall of the housing 48. The turntable 10 may be provided with further appropriate means for additionally supporting the individualization of the coins on the turntable 10. Such means are known per se and, therefore, are not described here in detail.

When a coin placed on the turntable 10 arrives at the location of the accelerating wheel 22, it will be frictionally engaged by the peripheral surface of the rotating accelerating wheel 22 and accelerated in the direction of the coin track by the rotation of the accelerating wheel, whereby the coin can slide, alone by this acceleration, to the end of the coin track 12 remote from the turntable 10. To this end, the peripheral surface of the accelerating wheel 22 consists of a material appropriate for frictional engagement of the coins, for example rubber.

In this procedure, the duration of acceleration is determined by the contact time of the accelerating wheel 22 with the coin to be accelerated. In the illustrated embodiment, this acceleration time is considerably shorter than the running time of the coins on the coin track 12. As well, the speed of the coin on the coin track 12 is nearly constant, as the friction becomes near zero thanks to the air cushion.

After acceleration, the coins, at first, slide past the coin recognition device 24. The coin recognition device 24 is able to recognize the coins on the basis of a certain feature, the size or the coinage of the coin are detected by the CCD-image. The deflection devices 14, 16, 18 and 20 are actuated depending on the recognition of the feature. One deflection device is allotted to each type of coin. The deflection device associated with the respective recognized coin is actuated in such a way that the recognized coin is sent to the associated deflection opening 16', 18', or 20'. Appropriate collecting containers (not shown) for collecting the coins are connected to the deflection openings 16', 18' and 20'.

The deflecting device 14 serves to send coins which have not clearly been recognized into the associated deflection opening 14'. From there, these not-recognized coins are returned through a coin return device 30 back to the turntable and thus can be examined anew by the coin recognising device 24 in a separate operative step.

If a collecting container is full, this can be detected by appropriate sensor means or is determined by counting the pulses supplied to the deflection device. The provision can be made to prevent coins of the respective type to reach the corresponding deflection opening 16', 18' or 20', respectively. This can be done by de-activating the respective deflection device 16, 18 or 20, respectively, or by means of a blocking element, by which the respective deflection opening 16', 18' or 20', respectively, is blocked. Coins of this type of coins are either sorted into another collecting container or slide up to the end of the coin track 12 remote from the turntable 10. There, they are returned to the turntable 10 by a second coin returning device 34 through the conveyor belt 26. Thereby, a full collecting container can be exchanged without interrupting the operation of the device.

Appropriate counting devices permit counting of the coins of the respective type of coins. These counting devices may either be light barriers at the deflection openings 16', 18' or 20', respectively, or may be actuated directly by the coin recognizing device 24. Such counting devices are well known and, therefore, are not described in detail here.

The accelerating wheel 22 is driven by appropriate driving means (for example an electric motor). These driving means may be designed such that the rotary speed of the accelerating wheel 22 can be varied, whereby the acceleration of the coins can be varied. Furthermore, the accelerating wheel 22 may be adjustable in height by appropriate means, whereby the acceleration wheel can be adapted to different thickness of the coins. These drive means and these means for adjusting the height are integrated in the suspension 34 of the accelerating wheel 22 illustrated in FIG. 2.

Furthermore, the accelerating wheel 22 may be loaded in the direction of the turntable 10 by an adjustable spring device 36. By adjusting the spring device 36, the contact force between the accelerating wheel 22 and the coins to be accelerated can be optionally varied. The deflection devices 14, 16, 18 and 20 may comprise mechanically acting parts, for example extensible pins, which push the associated coins into the associated deflection openings 14', 16', 18' or 20', respectively. The deflection devices may, however, also be designed to generate air jets, by which the coins are sent into the deflection openings 14', 16', 18' or 20', respectively.

In the illustrated device, it may be advantageous to take certain measures to prevent coins from being unintentionally transferred from the turntable to the coin track 12. This risk exists indeed, as the coins may, occasionally, leave the turntable under the action of the centrifugal force alone. These measures may be realized by a small stop between the turntable 10 and the coin track 12. This stop can be provided by slightly offsetting, inclining or laterally tilting the coin track 12 relative to the turntable 10. In the illustrated device, this is realized by a slight tilt of the coin track, whereby a small oblique step 38 is formed. Coins which are located at the edge of the turntable 10 and which, for one reason or other, nevertheless are not grasped by the accelerating wheel, are retained by this step 38 and prevented from leaving the turntable 10.

In the illustrated embodiment, the coin track 12 has small, uniformly distributed air passage openings 40, which are illustrated in FIG. 2 by small circles. These air passage openings 40 are circular and smaller than the diameter of the smallest coin to be transported. In the illustrated embodiment, the air passage openings 40 have a diameter of 1 mm and are arranged in the coin track 12 with a density of 4 to 6 openings per square centimeter. Pressurized air is supplied from below through these air passage openings 40, whereby an air cushion is generated between the coins and the coin track 12. Thereby, friction between the coins and the coin track 12 is reduced. The air flow is generated by a compressor having a capacity of 3000 litres per hour and is adjusted through a valve such the largest (or most heavy) of the coins to be transported is actually subject to the effect of the air cushion.

In the illustrated embodiment, the bores of the air passage openings are normal to the coin track 12. The air passage openings 40 may, however, be inclined into the direction of movement of the coins, whereby the movement of the coins along the coin track 12 is supported by the air flow emerging from the air passage openings 40.

In the illustrated embodiment, the coin recognizing device 24 has a CCD-sensor 42 and light emitting diodes (LEDs) 44. The CCD-sensor 42 and the LEDs 44 are arranged below the coin track 12 in a section in front of the first deflection device 14. In this section, the coin track 12 is provided with a sapphire glass 46. Through this sapphire glass 46, the coins are illuminated by the LEDs 44 and are observed by the CCD-sensor. The LEDs may emit radiation in the visible or the infrared range. The image generated by the CCD-sensor is evaluated by image recognition means and is associated with a particular type of coin. Such image recognition devices are known per se and are, therefore, not described in detail here.

Alternatively or in addition to the coin recognition device 24, further coin recognition devices may be provided, both below and above the coin track 14.

I claim:

1. A device for sorting, counting and/or examining objects of a collective of objects, in particular flat objects such as coins or the like, the collective of objects containing objects of different features, comprising:

(a) an object individualizing device (10) for individualizing the objects of the collective of objects, (b) an object track (12) along which the individualized objects continuously move, after they have left the object individualizing device (10), (c) object accelerating means (22) for accelerating the objects when leaving the object individualization device (10), (d) object recognition means (24) for recognizing objects having different features while the objects are moving along the object track, and (e) means (14,16,18,20) for selectively conveying the objects depending on one or more features of the objects, characterized in that (e) the object track (12) comprises air-cushion-forming means (40).

2. A device as claimed in claim 1, characterized in that the object track (12) is operative such that the objects move along a portion of the object track (12) free from force-exerting and mechanically engaging force means acting in the direction of movement of the objects.

3. A device as claimed in claim 1, characterized in that the object accelerating means comprise an accelerating wheel (22) the peripheral surface of which engages the objects, when the objects are accelerated.

4. A device as claimed in claim 1 characterized by means (38) arranged between the object individualizing device (10) and the object track (12) for preventing unintentional transferring objects from the object individualizing device (10) to the object track (12).

5. A device as claimed in claim 1, characterized in that the object track (12) has a transparent section (46) which permits observation of the objects therethrough.

6. A device as claimed in claim 1, characterized in that the object recognition means (24) comprise sensor means (42) for detecting the objects and image recognition means for recognizing the image of the objects detected by the sensor means (42).

7. A device as claimed in claim 1, characterized in that the means for selectively conveying the objects comprise deflection means (14,16,18,20) for deflecting the objects from the trajectory defined by the object track.

8. A device as claimed in claim 1, characterized in that the means for selectively conveying the objects comprise re-conveying means (30) for re-conveying the objects to the object individualizing device (10).

9. A method for sorting, counting and/or examining objects of a collective of objects, in particular flat objects such as coins or the like, the collective of objects containing objects of different features, wherein (a) the objects of the collective of objects are individualized, (b) the objects, after having been individualized, are directed along an object track (12), (c) the objects are accelerated, before they are directed along the object track (12)

(d) the objects are inspected on the object track (12) while they move along the object track and are classified after certain features, and (e) the objects are selectively conveyed in different ways depending on one or more features of the objects, characterized in that the objects on the object track slide along the object track floating on an air cushion.

10. A method as claimed in claim 9, characterized in that the objects are moved along a portion of the object track free from force-exerting and mechanically engaging contact means acting in the direction of movement of the objects.

11. A method as claimed in claim 9, characterized in that the acceleration of the objects is generated by means of an accelerating wheel (22) the peripheral surface of which engages the objects, when the objects are being accelerated.

12. A device for sorting, counting and/or examining objects of a collective of objects, in particular flat objects such as coins or the like, the collective of objects containing objects of different features, comprising:

(a) an object individualizing device for individualizing the objects of the collective of objects, (b) an object track along which the individualized objects continuously move; after they have left the object individualizing device;

(c) object accelerating means for accelerating the objects onto the object track when leaving the object individualization device, (d) air-cushion-forming means for creating an air cushion along the object track such that the objects move from the object accelerating means along the object track free from force-exerting and mechanically engaging force means acting in the direction of movement of the objects, (e) object recognition means for recognizing objects having different features while the objects move along the object track, and (f) a plurality of deflection means positioned along the track for deflecting the objects off of the track at selected locations along the track depending on one or more recognized different features of the objects.

13. A device as claimed in claim 12, wherein the object track includes a side wall extending along the object track, and wherein each of the plurality of deflection means includes a deflection opening through the side wall through which selected objects are deflected.

14. A device as claimed in claim 13, wherein each of the plurality of deflection means includes an associated deflection device positioned along a side of the object track opposite the associated deflection opening.

15. A device as claimed in claim 14, wherein each of the deflection devices includes air jet generating means which, when an air jet is generated, the air jet directs a selected object through the associated deflection opening.

16. A device as claimed in claim 14, additionally including a collecting container associated with each of a plurality of the deflection openings to collect objects deflected through respective deflection openings.

17. A device as claimed in claim 16, additionally including an object return device associated with one of the plurality of deflection openings for returning objects deflected through the one deflection opening to the object individualizing device.

18. A device as claimed in claim 12, additionally including a collecting container associated with each of a plurality of the deflection means to collect objects deflected by respective deflection means.

19. A device as claimed in claim 18, additionally including an object return device associated with one of the plurality of deflection means for returning objects deflected through the one deflection means to the object individualizing device.

20. A device as claimed in claim 12, wherein the object track has an end remote from the object individualizing device and additionally including an object returning device associated with the end of the object track remote from the object individualizing device for returning objects not deflected by a deflection means to the object individualizing device.

* * * * *